United States Patent [19]

Sideman et al.

[11] Patent Number: 4,619,665

[45] Date of Patent: Oct. 28, 1986

[54] SHEET CONTAINING HEAT TRANSFERABLE DYE AND SELECTIVE BLOCKING AGENT FOR HEAT TRANSFER PRINTING

[75] Inventors: Carl E. Sideman, Columbia; Thomas E. Lewis, Lexington, both of S.C.; Michael T. Nowak, Gardner, Mass.

[73] Assignee: Technographics Printworld, Inc., Fitchburg, Mass.

[21] Appl. No.: 710,745

[22] Filed: Mar. 11, 1985

[51] Int. Cl.[4] ..... B41M 5/26

[52] U.S. Cl. ..... 8/402; 8/470; 8/471; 8/506; 428/195; 428/200; 428/913; 428/914

[58] Field of Search ..... 8/470, 471, 402, 506; 428/195, 913, 914, 500; 427/256

[56] References Cited

U.S. PATENT DOCUMENTS 4,171,202 10/1979 Sideman et al. ..... 8/471

*Primary Examiner*—Bruce H. Hess

*Attorney, Agent, or Firm*—Russell, Georges, Breneman, Hellwege & Yee

[57] ABSTRACT

Transfer sheets are provided which include a polyethylene imine as a blocking agent and which are useful in the heat transfer dye printing of various materials such as textiles. The polyethylene imine is capable of completely or partially blocking the transfer of sublimable dyes which have been imprinted on the transfer sheet while having no effect on other dyes which also have been imprinted on the transfer sheet. By using such transfer sheets, designs can be printed which are not otherwise obtainable by conventional techniques. The invention further concerns the method of making such sheets, their use in the printing of various materials, and the materials which have been so printed.

19 Claims, 3 Drawing Figures

SHEET CONTAINING HEAT TRANSFERABLE DYE AND SELECTIVE BLOCKING AGENT FOR HEAT TRANSFER PRINTING

BACKGROUND OF THE INVENTION

The present invention relates to the field of heat transfer printing by means of transfer sheets having sublimable dyes thereon.

It is known to employ blocking agents in conjunction with a transfer sheet which contains a heat transferable dye in order to immobilize portions of the dye during the printing process. See, for example, U.S. Pat. No. 4,171,202 issued to Carl E. Sideman and Thomas E. Lewis on Oct. 16, 1979. In the Sideman et al patent a blocking agent is employed which is chemically reactive with at least one of the heat transferable dyes, with disclosed exemplary blocking agents including hydrosulphites, isocyanates, aminoplasts, epoxy resins, melamine-based compounds and glyoxal-based compounds.

Similarly, Japanese Laid-Open Specification No. 40310/1978 of Apr. 12, 1978 discloses a transfer sheet which includes both a heat transferable dye layer and an anti-dyeing layer which serves to block transfer of the dye in specific areas. The blocking agents which are disclosed comprise metallic compounds such as compounds of the metals chromium, iron, copper, nickel and cobalt.

More specifically, the heat transfer printing process such as described in the noted Sideman et al patent is effected by heating the transfer sheet and the material to be printed, both of which have been placed together, at a temperature of from about 160° to 220° C., for a sufficient period of time to allow the heat transferable dye on the transfer sheet to sublime or vaporize and then to diffuse and penetrate into the material which is being printed. The blocking agent is deposited on a portion of the dye and during the heating process undergoes a chemical reaction with at least a portion of the dye upon which it has been deposited. The reacting dye is subsequently unable to sublime or vaporize and therefore is not transferred. The extent of this reaction depends upon the nature of the dye used and the concentration of the blocking reagent. By varying the concentration, either complete blockage of dye transfer or partial blockage to produce shading effects can be obtained.

A limitation on the process described in U.S. Pat. No. 4,171,202 has been that designs transferred by the process are limited to some combination of (1) the underlying color of the material being printed; (2) the color of the dye transferred; and (3) some lighter shade of the dye transferred achieved by partial blocking. These limitations arise because the blocking agents heretofore known have the ability to react with a broad range of dyes, making it very difficult to layer dye colors on the same substrate and selectively transfer one while blocking the other. Thus many desirable fabric patterns could not be accomplished by the process heretofore known. For example, patterns wherein many small dots of one color appear in a background of a second color could not be achieved in cases where each color had to be printed onto a colorless (white) background. Two color printing in such a case is also difficult or impossible because of the registration tolerances required.

It is thus desirable to provide a heat transfer sheet which includes a heat transferable dye and a blocking agent which is selective as to its blocking activity with regard to various classes of dyes to enable greater control of dye transferability to be achieved.

SUMMARY OF THE INVENTION

A transfer sheet is thus provided which is useful in heat transfer printing and comprises a substrate, a polyethyleneimine blocking agent deposited on at least one portion of the substrate, and at least one dye which is reactive with the polyethyleneimine deposited on the substrate, at least a portion of the dye being in contact with the polyethyleneimine. The polyethyleneimine has the property of reacting with and blocking selected dyes while remaining non-reactive with other selected dyes. Advantageously, the non-reactive dye can be deposited with the polyethyleneimine. In each instance, designs may be obtained which have heretofore been impossible to obtain by single run heat transfer process.

DETAILED DESCRIPTION OF THE INVENTION

Specifically, this invention provides transfer sheets useful for the heat transfer dye printing of various materials, especially synthetic textile fabrics. The transfer sheets of the present invention comprises a substrate on one surface of which one or more heat transferable dyes have been imprinted together with the polyethyleneimine blocking agent.

Figure 1:
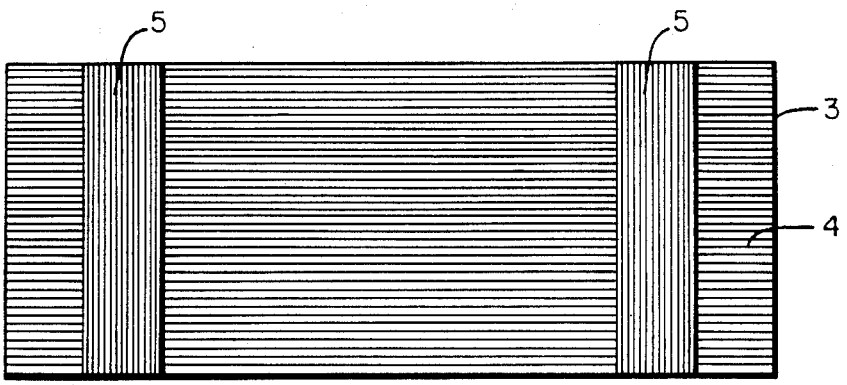
FIG. 1 is a plan view of a heat transfer sheet constructed in accordance with the present invention.

A heat transfer sheet constructed in accordance with the present invention is shown in FIG. 1. The sheet comprises a substrate 3 (e.g., paper) having a colored layered 4 thereon comprised of one or more dyes (which are either reactive or non-reactive with the blocking agent). A polyethyleneimine blocking agent 5 is deposited on the colored layer 4.

Figure 2:
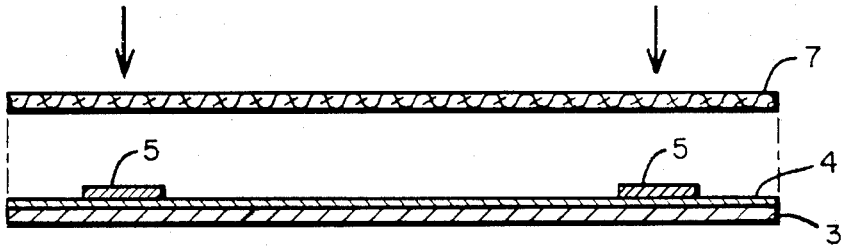
FIG. 2 is a cross-section showing the heat transfer sheet of FIG. 1 in contact with a material to be printed.
Figure 3:
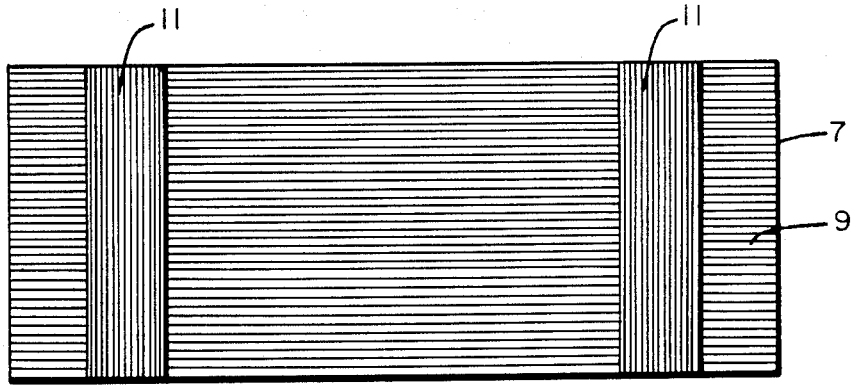
FIG. 3 is a plan view of the printed substrate after transfer.

As illustrated in FIG. 2, this sheet is designed to be placed in contact with the substrate 7 to be printed. Upon application of heat to the sheet during contact with substrate 7, the colored layer 4 sublimes and transfers to substrate 7. Sheet 7, after transfer, is shown in FIG. 3 having been colored, as indicated by transferred color layer 9. As hereinafter more particularly described, the color at 11 (corresponding to the location of the blocking agent on sheet 3) differs from the color of the rest of the substrate.

In formulating colored layer 4, dyes are selected so that one or more are reactive with the blocking agent 5 and one or more are non-reactive with the blocking agent 5. Blocking agent 5 accordingly then blocks (either partially or entirely) the transfer of the reactive dyes and allows transfer of the non-reactive dyes to produce a color as shown at portion 11 of sheet 7.

As hereinbefore described, the basis of the present invention resides in the use of a polyethyleneimine as the blocking agent. Exemplary polyethyleneimines include both linear and branched polyethyleneimines. Such imines include but are not limited to those represented by the following:

(1) linear polyethyleneimines of the formula $R_1—(CH_2CH_2NH)_n—R_2$ where $R_1$ and $R_2$ are chain terminating groups such as alkyl, hydroxyalkyl, aminoalkyl, $NH_2$, hydrogen, etc., and n is an integer greater than 1; and (2) branched polyethyleneimines of the formula $R_3—(CH_2CH_2NR_4)_y—R_5$ where $R_3$ and $R_5$ are chain terminating groups such as alkyl, hydroxyalkyl, aminoalkyl, $NH_2$, hydrogen, etc.; y is an integer greater than 1; and $R_4$ is alkyl of 1 to 4 carbon atoms or $—(CH_2CH_2NH)_zR_6$ where $R_6$ is a chain terminating group such as alkyl, hydroxyalkyl, aminoalkyl, $NH_2$, hydrogen, etc. and z is an integer greater than 1.

Linear polyethyleneimines are commercially available from BASF under the tradename Polymin P while branched polyethyleneimines are commercially available from the Cordova Chemical Company under the tradenames Corcat P-145, Corcat P-12, Corcat P-18.

The polyethyleneimine may be deposited on the heat transfer sheet in the form of a composition which comprises the polyethyleneimine and a suitable solvent. Exemplary solvents include but are not limited to water, alcohols, glycols and glycol ethers. Various modifiers, dyes, extenders, etc., may also be incorporated. The composition may be applied by means of conventional techniques such as a gravure, flexographic, letter press, etc.

The non-reactive and reactive dyes used in the present invention are both referred to as heat transferable dyes; i.e., dyes which are capable of subliming or vaporizing at about 160° to 220° C., more or less, at atmospheric pressure.

Reactive and non-reactive dyes can be selected from nitroso, nitro, monoazo, disazo, trisazo polyazo, stillbene, carotenoid, diphenylmethane, triarylmethane, xanthene, acridine, quinoline, methine, thiazole, indamine, indophenol, azine, thiazine, sulphyr, lactone, aminoketone, hydroxyketone, anthraquinone, indigoid, and phthalocyanine dyes.

Heat transferable dyes which have been found useful in the practice of the present invention and which are blocked by polyethyleneimine include those within the following general classes of dyes (with R generally referring to a hydrogen or lower alkyl substituent):

Blue-Violet dyes:

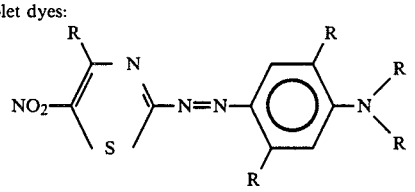

Yellow dyes:

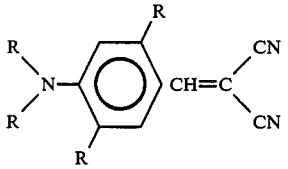

Yellow dyes:

-continued

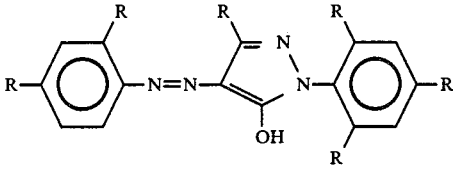

Orange-Brown dyes:

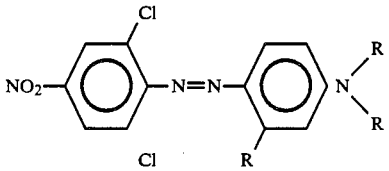

Disperse Red 1:

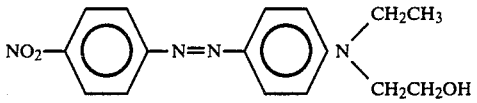

Heat transferable dyes which have been found useful in the practice of the present invention and which are not blocked by polyethyleneimines include those within the following general classes of dyes (with R generally referring to hydrogen or lower alkyl substituents):

Yellow-Orange dyes:

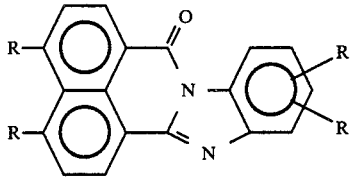

Disperse Yellow 23:

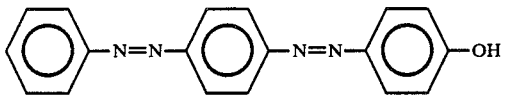

Disperse Yellow 54:

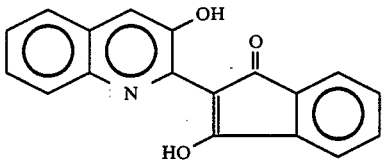

Disperse Red 60:

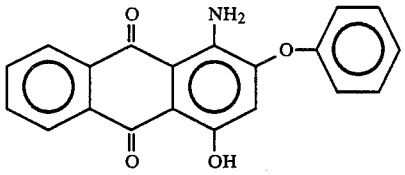

Disperse Blue 14:

-continued

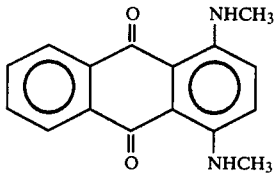

G/S Blues:

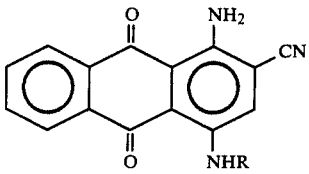

Solvent Orange 60:

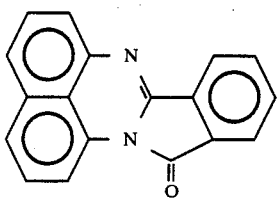

From the foregoing exemplary dyes, it can be generally concluded that a given dye will react with polyethyleneimine if either "fixed" double bonds containing one or more positively polarized carbons are present or if substituent groups describable as alkyl halides ($—CH_2CH_2—X$) are present. On the other hand, the absence of either of the aborementioned structures indicates that the dye will be non-reactive with polyethyleneimine.

One or more such heat-transferable dyes are imprinted on the substrate, typically in the form of an ink or inks, which usually further comprise a binder and an organic solvent. The dye or dyes can be imprinted as solid colors or in patterns or designs. The solvents are of the type generally used in heat transfer printing, that is, substantially anhydrous organic solvents. By substantially anhydrous organic solvents are meant solvents or mixtures of solvents which are miscible or immiscible with water, contain less than about 15 percent by weight of water and have a boiling point at atmospheric pressure lower than about 120° C., preferably lower than about 105° C. Examples of suitable solvents are hydrocarbons or halogenated hydrocarbons, e.g., hydrocarbons of the aliphatic or aromatic series such as toluene, cyclohexane and petroleum ether, alcohols of low molecular weight such as methanol, ethanol, propanol and isopropanol, esters of aliphatic acids such as ethyl acetate, and ketones such as methyl ethyl ketone. The solvents can be used singly or in admixture. One skilled in the art can readily determine which solvent to employ.

The binders used in the noted inks do not and desirably should not decompose at the temperature at which the transfer is carried out. Suitable binders are available commercially and are widely used in heat transfer printing. Binders which have a low solids content are preferred. The binders should be capable of drying to yield a non-tacky film which binds the dye or dyes used. Inert binders which have relatively little or no tendency to decompose and which bind the sublimable or vaporizable dye or dyes without modifying the dye or dyes themselves are particularly preferred.

The ink or inks are imprinted according to known techniques, preferably by application of one or more anhydrous or substantially anhydrous inks, that is to say, one or more anhydrous or substantially anhydrous solutions, varnishes, emulsions or dispersions which contain dissolved or finely dispersed dye or dyes. When two or more dyes are used in the ink or inks preferably they exhibit similar sublimation or vaporization characteristics or curves over a range of temperature of about 180° to 210° C. at atmospheric pressure. By sublimation or vaporization curve is meant a plot of the amount of dye subliming or vaporizing over a given time at a given temperature. The curves of two or more dyes are said to be similar when their rates of sublimation or vaporization change to a similar extent in relation to change of temperature within the aforesaid range.

The inks containing the heat transferable dyes will be formulated so as to be appropriate to the printing or coating method employed. Selection of binders, solvents, extenders are matters well within the skill of a chemist in the art. For example, a gravure heat transfer ink could comprise a heat transfer dye dispersed in a vehicle comprised of an ethyl cellulose binder dissolved in an ethyl alcohol vehicle. Likewise, a water-based flexographic heat transfer ink could be prepared by dispersing a heat transfer dye in a vehicle composed of an acrylic resin dissolved in a water/isopropanol blend. A hot melt coating may be prepared by dispersing the dye in a high melting wax mixture. A rotary screen ink could be prepared by using a dispersed dye paste compounded with a thickening agent and water.

The amount of polyethyleneimine employed will vary depending on the amount needed to react with the reactive dye and provide the desired degree of blockage. The amount can be varied to provide partial blocking thereby providing a shading to the transferred unreacted dye as opposed to complete blockage. The blocking ability of the polyethyleneimine is related to the number of the available reactive sites in the polyethyleneimine and the concentration of the dye to be blocked. Total blockage occurs when the number of available reactive sites in the polyethyleneimine is sufficient to completely react with all of the adjacent reactive dye molecules.

Preferably, an aqueous solution of the polyethyleneimine is formulated with a non-reactive dye (optionally) and a suitable solvent and then printed over a previously-applied colored layer comprised of at least one reactive dye as illustrated in FIG. 2. In addition to acting as a blocking agent, the polyethyleneimine also serves as a resinous binder. Optionally, silica or other thixotropic agents can be added to reduce tackiness and control viscosity. Of course, the polyethyleneimine may also be applied to the substrate prior to application of the layer of reactive dyes.

The transfer sheet of the present invention can be used in the printing of various substrates. For example, textile materials prepared from synthetic fibers, such as polyamides, polyesters and acrylics, are particularly receptive to the application of heat transfer dyes. When appropriate pretreatments are used, cellulosics and cellulosic containing blends may be used. Wood, plastic films and metal foils, provided with dye receptive coatings, are also suitable for printing. The substrate may be in the form of a sheet, strip, or tape, etc. and may be rigid or flexible.

Heat transfer printing is affected by heating the structure and material to be printed, both of which have been placed together, to a temperature of from about 160° to 220° C. for a period of time sufficient to allow the heat transferable dye to convert to a mobile phase and to transfer to the material which is being printed. During the heating step the polyethyleneimine blocking agent undergoes a chemical reaction with at least one of the dyes upon which it has deposited. A dye non-reactive with the polyethyleneimine, incorporated either in an adjacent layer or in the polyethyleneimine layer, will be transferred to the substrate to be printed. The blocking reaction occurs either at the time of contact of the blocking agent with the dye and/or during the heating process when the unreacted dye becomes mobile.

The following examples are provided to merely illustrate the invention and are not intended in any way to limit the scope thereof. Parts and percentages are expressed by weight unless an indication to the contrary is provided.

EXAMPLE 1

A paper is printed with 10% Intratherm Blue P-309 dye (a Blue-Violet dye) using an etched plate and overprinted with a positive dot plate. The inks printed with the positive dot are formulated from a Disperse Red 60 dye in polyethyleneimine according to the following formulation:

15% Disperse Red 60 dye
25% polyethyleneimine aqueous solution (50% solids)
60% isopropanol (99%)

The polyethyleneimine employed was Polymin P (BASF) consisting of a linear polyethyleneimine in the form of 50 percent solids in water.

The paper is employed in the heat transfer to polyester fabric under conventional conditions yielding a print in which bright red dots are in a bright blue background. This indicated that the blue was totally blocked in the dotted area, because otherwise the dots would have been purplish after transfer due to the conflicting transfer of the blue dye.

EXAMPLE 2

A transfer sheet was prepared by printing a paper sheet with five overlapping ink layers in a selected pattern as follows:

(a) Layer 1: black ink covering the entire sheet, the black ink comprising a mixture of Intratherm Blue P-309, Intratherm Brown P-303 (an Orange-Brown dye) and Disperse Yellow 116 (a Yellow dye).

(b) Layer 2: 70 grams of the polyethyleneimine solution of Example 1; 3% Syloid 161 (silica filler) and 72% isopropanol (solvent); 15 grams Disperse Red 60; 20 grams Disperse Yellow 54.

(c) Layer 3: 60 grams of the polyethyleneimine solution of Example 1; 40 grams Disperse Red 60; 15 grams Disperse Yellow 54.

(d) Layer 4: 80 grams of the polyethyleneimine solution of Example 1; 20 grams Disperse Yellow 54; 10 grams Disperse Blue 14.

(e) Layer 5: 50 grams of the polyethyleneimine solution of Example 1; 50 grams Disperse Red 60; 5 grams Disperse Blue 14.

The pattern thus created on the sheet was transferred to a fabric substrate by heat transfer under conventional conditions. The black ink layer 1 was blocked out in the areas covered by layers 2, 3, 4 and 5 and the colors in each of layers 2, 3, 4 and 5 were transferred to the fabric as full colors or as tones in those areas where there was overlap with one or more of layers 2, 3, 4 or 5. The black layer 1 was transferred to the fabric only in those areas not overlayed by layers 2, 3, 4 or 5.

As will be obvious to one skilled in the art, many modifications and variations are possible with regard to the invention without departing from the scope and spirit thereof, as set forth in the claims to follow.

What is claimed is:

1. a transfer sheet useful in heat transfer printing, said transfer sheet comprising a substrate; at least one heat transferable dye on one surface of said substrate which dye sublimes or vaporizes at a temperature in the range of from about 160 to 240 °C.; and a polyethyleneimine blocking agent deposited on or below at least a portion of said at least one dye, said polyethyleneimine being chemically reactive with at least one of said heat transferable dyes.

2. The transfer sheet of claim 1 wherein a plurality of dyes are deposited on said substrate and at least one of the dyes so deposited does not chemically react with said blocking agent.

3. The transfer sheet of claim 1 wherein said blocking agent is a linear polyethyleneimine.

4. The transfer sheet of claim 3 wherein said linear polyethyleneimine is of the formula $R_1$-$(CH_2CH_2NH)_n$-$R_2$ where $R_1$ and $R_2$ are chain terminating groups and n is an integer greater than 1.

5. The transfer sheet of claim 1 wherein said blocking agent is a branched polyethyleneimine.

6. The transfer sheet of claim 5 wherein said branched polyethyleneimine is of the formula $R_3$-$(CH_2CH_2NR_4)_y$-$R_5$ where $R_3$ and $R_5$ are chain terminating groups; y is an integer greater than 1; $R_4$ is alkyl of from 1 to 4 carbon atoms or —$(CH_2CH_2NH)_z$—$R_6$ where $R_6$ is a chain terminating group and z is an integer greater than 1.

7. The transfer sheet of claim 1 wherein said blocking agent is deposted on the at least one heat trasferable dye.

8. The transfer sheet of claim 1 wherein said blocking agent is deposited below said at least one heat transferable dye.

9. The transfer sheet of claim 1 wherein said blocking agent is deposited in the form of a composition comprising the polyethyleneimine and a solvent.

10. A method for heat transfer dye printing comprising (1) providing a transfer sheet comprising a substrate, at least one heat transferable dye being on one surfaces of the substrate which dye sublimes or vaporizes at a temperature in the range of from about 160° to 240° C., and a polyehtyleneimine blocking agent deposited on or below at least a portion of said at least one dye, said polyethyleneimine being chemically reactive with at least one of said heat transferable dyes; (2) placing said transfer sheet in contact with a material to be printed; and (3) heating said transfer sheet to a temperature and for a time sufficient to cause the heat transferable dye which is not in contact with the blocking agent to transfer to the surface of said material to be printed.

11. The method of claim 10 wherein said transfer sheet is heated to a temperature in the range of about 160° to 240° C.

12. The method of claim 10 wherein said material to be printed comprises a textile material.

13. The method of claim 10 wherein said material to be printed comprises wood, metallic foil or a plastic film.

14. The method of claim 10 wherein said polyethyleneimine comprises a linear polyethyleneimine.

15. The method of claim 14 wherein said linear polyethyleneimine is of the formula $R_1—(CH_2CH_2NH-)_n—R_2$ where $R_1$ and $R_2$ are chain terminating groups and n is an integer greater than 1.

16. The method of claim 10 wherein said polyethyleneimine is a branched polyethyleneimine.

17. The method of claim 16 wherein said branched polyethyleneimine is of the formula $R_3—(CH_2CH_2NR_4)_y—R_5$ where $R_3$ and $R_5$ are chain terminating groups; y is an integer greater than 1; $R_4$ is alkyl of from 1 to 4 carbon atoms or $—(CH_2CH_2NH)_z—R_6$ where $R_6$ is a chain terminating group and z is an integer greater than 1.

18. The method of claim 10 wherein said blocking agent in said transfer sheet is deposited on the at least one heat transferable dye.

19. The method of claim 10 wherein said blocking agent in said transfer sheet is deposited below said at least one heat transferable dye.

* * * * *